United States Patent [19]

Suga

[11] 4,272,944

[45] Jun. 16, 1981

[54] APPARATUS FOR CONTINUOUSLY WRAPPING SUCCESSIVE ARTICLES UNDER VACUUM IN HEAT-SEALABLE FILM

[76] Inventor: Tadoru Suga, 5-5 Shinchujo-cho, Ibaragi-shi, Osaka-pref., Japan

[21] Appl. No.: 23,321

[22] Filed: Mar. 23, 1979

[30] Foreign Application Priority Data

Sep. 19, 1978 [JP] Japan ..... 53/128777[U]
Oct. 24, 1978 [JP] Japan ..... 53/146824[U]

[51] Int. Cl.[3] ..... B65B 31/04
[52] U.S. Cl. ..... 53/511
[58] Field of Search ..... 53/511, 433

[56] References Cited

U.S. PATENT DOCUMENTS

| | | | |
|---|---|---|---|
| 2,919,990 | 1/1960 | Podlesak et al. | 53/433 X |
| 3,274,746 | 9/1966 | James et al. | 53/511 X |
| 3,735,551 | 5/1973 | Pratt | 53/511 X |
| 3,958,390 | 5/1976 | Pringle et al. | 53/511 X |

*Primary Examiner*—Travis S. McGehee

*Attorney, Agent, or Firm*—Fisher, Christen & Sabol

[57] ABSTRACT

An improvement in the wrapping of successive articles in heat-sealable film supplied in a continuous length to an elongated generally tubular former which progressively wraps the film around the sides of the articles and seals the margins together while air is being evacuated from the interior of the wrapping material comprises the provision of a lengthwise slot in the tubular former and placing the vacuum supply pipe outside the former and near the slot so that the articles do not ride on, or come in contact with, this supply pipe. In the preferred form the margins of the film are sealed along a continuous line outside the supply pipe and along a discontinuous on the other side of the pipe so that air evacuation can take place. In a modification, the margins are overlapped and openings are provided near one margin to allow for the removal of air and in another modification the margins are overlapped and two lines of sealing are employed; one being continuous, to seal the wrapping as a whole, the other being discontinuous and on the other side of the pipe to allow for air removal.

5 Claims, 8 Drawing Figures

APPARATUS FOR CONTINUOUSLY WRAPPING SUCCESSIVE ARTICLES UNDER VACUUM IN HEAT-SEALABLE FILM

BACKGROUND OF THE INVENTION

This invention relates to wrapping articles in heat-sealed tubular material of thermoplastic film, in which the air is evacuated before the final sealing.

In prior apparatus of this type, a length of film from a supply roll is drawn into a tubular former along with successive articles to be wrapped. There is a slot along the top of the former and the margins of the film are drawn up around the articles to project through this slot in face to face relationship so that they can be heat-sealed together by means of a pair of cooperating heated rolls. In addition, an elongated pipe having at least one inlet opening and connected to a source of vacuum projects into the former along its bottom surface to evacuate air from the film wrapping as it is being sealed.

However, since this pipe lies at the bottom of the former, the articles being wrapped continually come in contact with it, and, in the case of food products, this creates an insanitary condition. In addition, this contact between the articles and the air evacuation pipe can sometimes cause articles to be caught by the pipe and create trouble in the operation of the apparatus.

BRIEF SUMMARY OF THE INVENTION

The present invention relates to apparatus for covering articles in a heat-sealed tubular wrapping of thermoplastic film in which the elongated pipe which is connected to a vacuum source is disposed along the exterior of the former so that there is no interference, or contact, with the articles being wrapped.

DETAILED DESCRIPTION OF THE INVENTION

Figure 8:
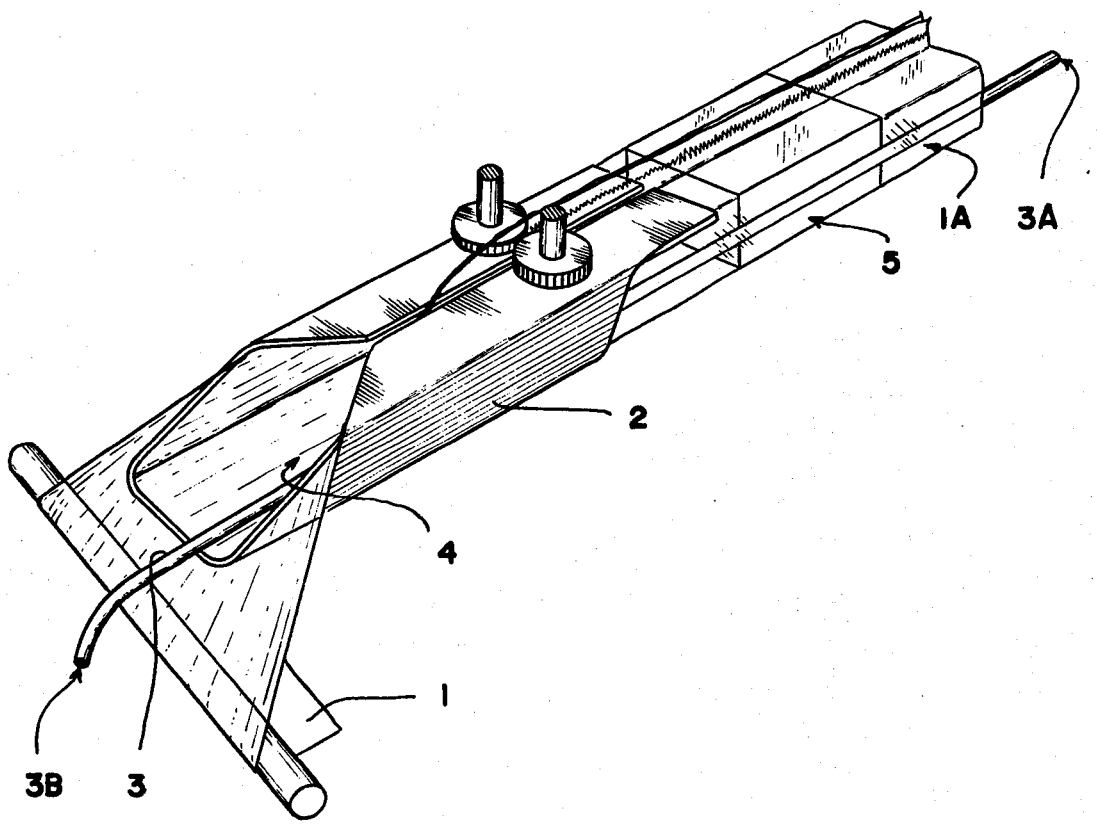
FIG. 8 is a perspective view of a portion of a known type of wrapping apparatus.

Hitherto, as shown by the usual type of packaging apparatus as seen in FIG. 8, a continuous sheet of heat-sealable thermoplastic film, indicated by numeral 1, is drawn from a supply roll (not shown) into an elongated tubular former 2 which has a slot running along its upper side through which the opposite margins of the film project so as to be sealed together by a pair of cooperating rollers to form a tube 1A of thermoplastic film. A thin pipe 3 is positioned along the bottom of the former 2, and within the tube of film, this pipe having an opening 3A in communication with the interior of the tube of film, the other end 3B being connected to a vacuum pump (not shown). Articles to be wrapped, indicated by numeral 5 are conveyed into the entrance 4 at regular intervals to be enclosed and sealed within the tube 1A.

In a packaging apparatus of this type, the usual type of vacuum packing and pressure reducing devices are not required and a simple air evacuation system may be used and continuous packaging can be done efficiently especially in the case of so-called throwaway articles.

However, as can be seen in FIG. 8, since the articles 5 are conveyed in such a way as to slide along the pipe 3, it is an insanitary system when used for packaging food products. Also, since the articles within the tube 1A are regularly moved in frictional contact between pipe 3 and the articles 5, trouble can easily occur such as articles being stopped at the point where a film severing and enclosing apparatus is located. Further, the reduction of atmospheric pressure within the tube 1A the articles 5 are additionally pressed against pipe 3.

In view of the above shortcomings in known packaging systems, in the present invention a passage is maintained outside of the forming guide 4 between the facing marginal portions of the film into which the air evacuating pipe is inserted, so that the vacuum packing of the articles is done without any contact between the pipe and the articles.

Figure 1:
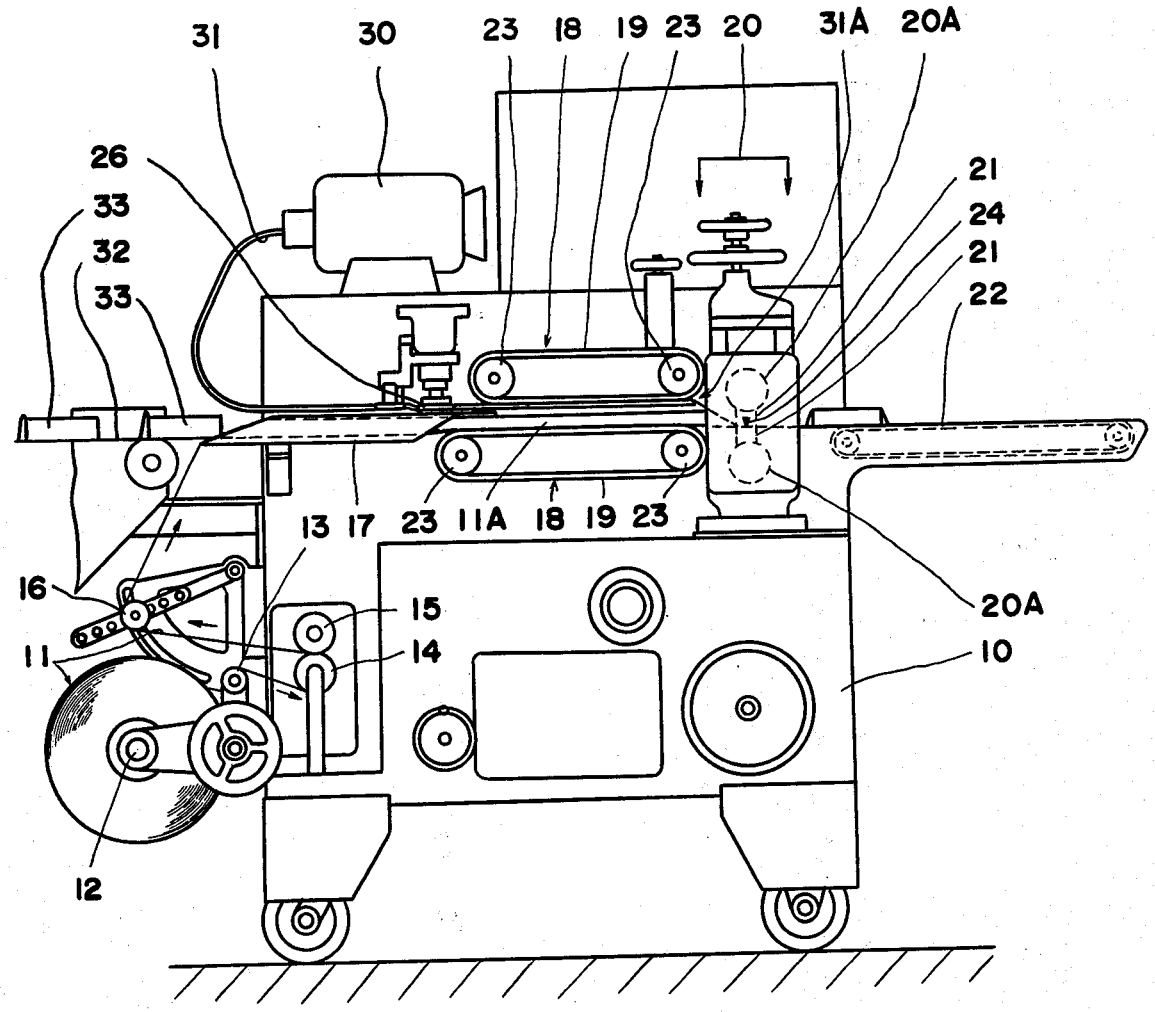
FIG. 1 is a side elevation of a preferred embodiment of packaging apparatus according to the present invention.

As shown in FIG. 1, substantially all of the mechanisms required are mounted on a stand 10, on the front end of which there is mounted a rod 12 for supporting a supply roll of transparent thermoplastic film 11, or similar material. Also mounted on stand 10 are an idler roll 13, supply rollers 14 and 15 and a control roller 16 of known construction. On the upper part of stand 10, from left to right. There are placed a tubular film forming guide 17, a pair of cooperating stretching means, indicated generally by numeral 18, an enclosing mechanism, indicated generally by numeral 20, which closes the ends of the packages and severs the film and a conveyor 22 which delivers the completed packages. The stretching means 18 comprises a pair of endless belts 19, made of a material such as urethane or similar material which is highly cushionary in nature, which are supported at their ends by a series of pulleys 23, these belts being arranged oppositely to each other at the outlet of the forming guide 17. The enclosing mechanism 20 comprises a pair of cooperating sealing rollers 20A mounted on shafts disposed transversely of the movement of the tube 1A. Each of the rollers is provided with a heater 21 and a cutter 24 mounted on their respective peripheries, the cutters extending in a direction parallel with the shafts. These mechanisms for sealing the ends of the packages and severing the film are known in the art.

Figure 2:
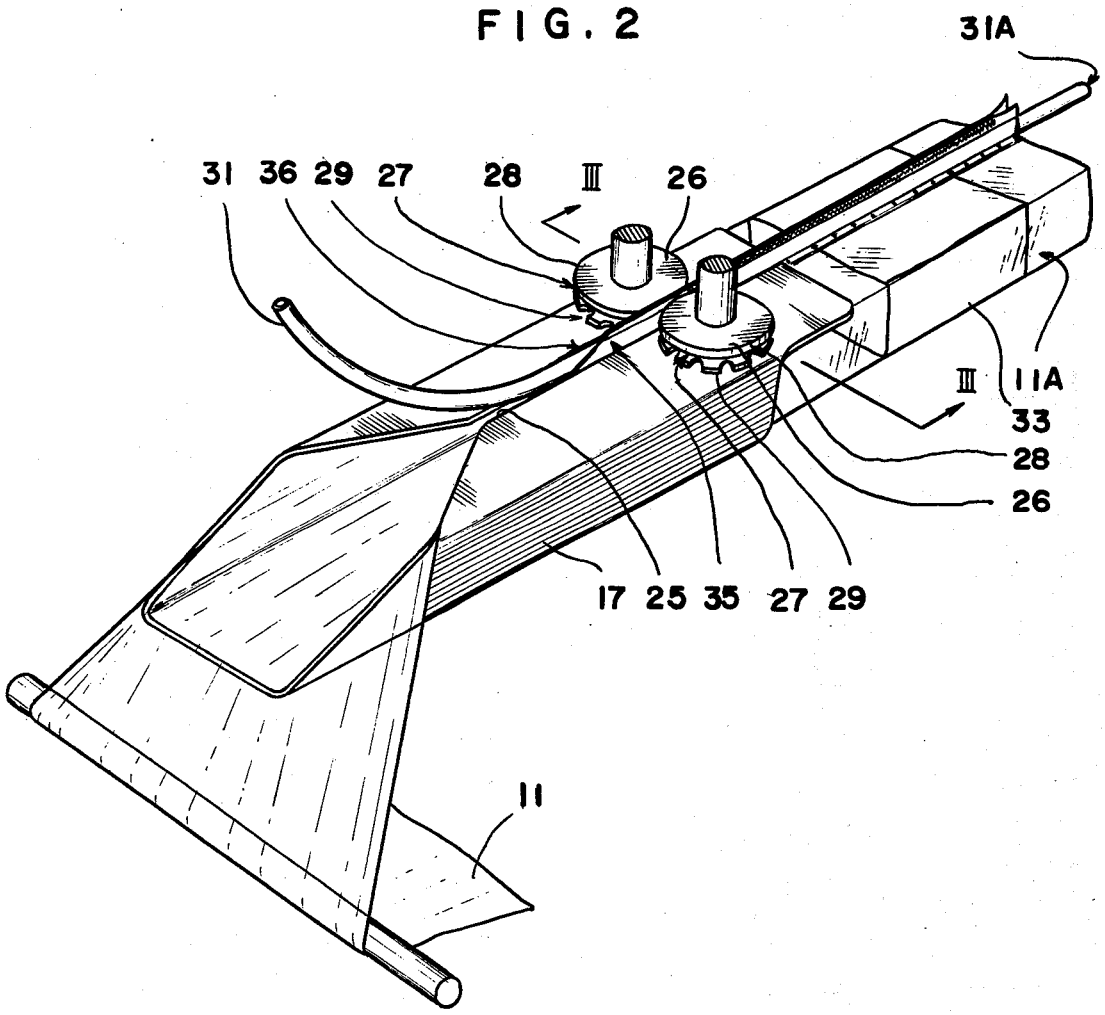
FIG. 2 is a perspective view of a portion of the apparatus shown in FIG. 1 on an enlarged scale.
Figure 3:
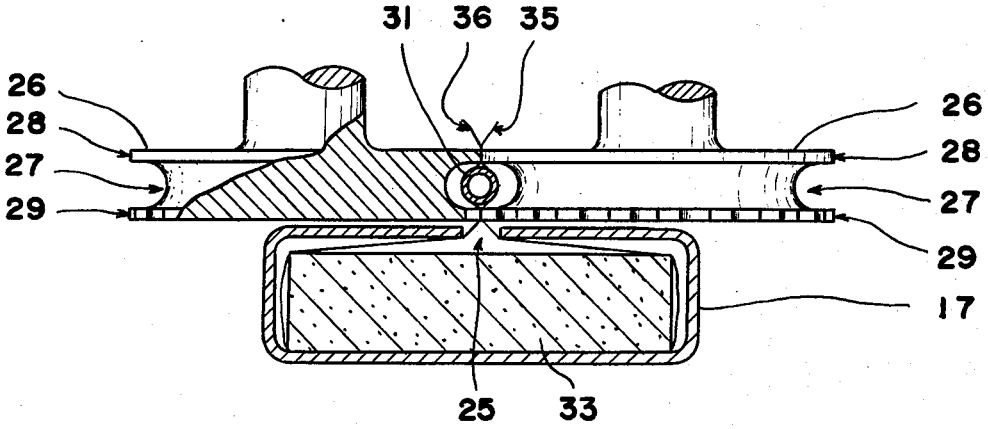
FIG. 3 is a vertical cross section on the line III—III of FIG. 2 with a portion of one sealing roller broken away.
Figure 4:
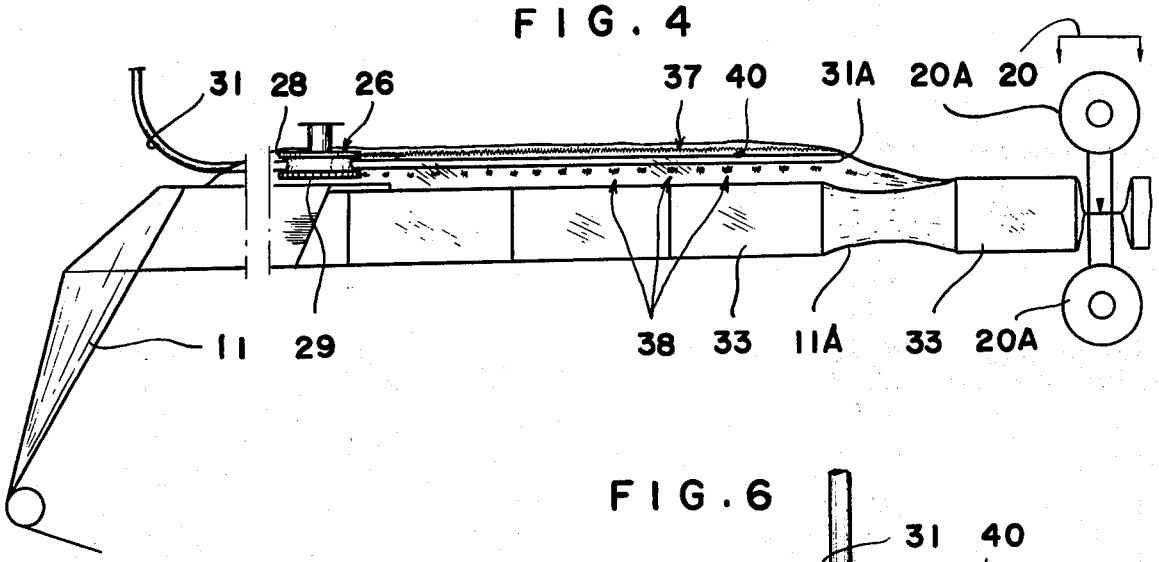
FIG. 4 is a side elevation of the elements of FIG. 2 and including a cutter and end sealing mechanism diagrammatically shown.

As shown in FIG. 2, the forming guide 17 comprises a tube having a generally rectangular cross-section which is provided with an elongated opening, or slot 25, extending from front to rear. A pair of cooperating heating rollers 26, mounted on shafts for rotation about vertical axes, are positioned above the slot 25 in former 17. As shown in FIG. 3, each of these rollers are provided around their circumferences with an annular groove 27. Above these grooves on each roller there is a continuous circumferential sealing flange 28 while each of the flanged portions 29 below the groove 27 are provided with cooperating spaced rectangularly shaped sealing areas resembling peripherally arranged teeth.

Referring back to FIG. 1, there is shown a source of vacuum, such as the vacuum pump 30, mounted on stand 10, to which is connected a small diameter pipe 31 which is arranged above the slot 25 to pass through the space between the grooves 27 of the heating rollers 26 (FIG. 3) and may extend forwardly near the enclosing mechanism 20.

Figure 5:
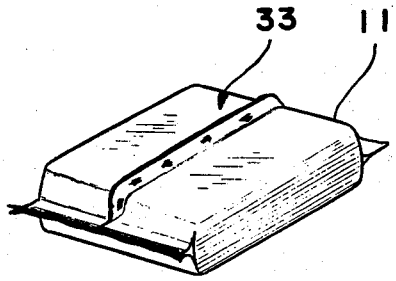
FIG. 5 is a perspective view of a packaged article.

In operation, the film 11 from the supply roll and is guided by idler 13, supply rollers 14 and 15 and control roller 16 up into the forming guide 17 where it assumes a tubular shape around the package 33 with its opposite margins projecting upwardly through the elongated opening 25. After passing through the former 17 the film is engaged by the stretching mechanisms 18 and the sealing rollers 20A of the enclosing mechanism so that the film is continuously moved from left to right as seen in FIGS. 1 and 2. Each article, or package, 33 is successively supplied from a feeding conveyor 32 to the entrance of the forming guide 17 and is arranged at regular intervals within the tube 11A produced by the guide 17. As shown in FIG. 3, the opposite margins 35 and 36 of film 11 project upwardly through the slot 25 in face to face relationship and are fused together by the rollers 26. Since the upper flanges 28 having continuous peripheral surfaces and the lower flanges 29 are provided with interrupted peripheral surfaces the opposite margins 35 and 36 are sealed together along a continuous line 37 at their outer (upper) margins and along an intermittent line 38 at their inner (lower) portions, with the pipe 31 enclosed therebetween. As a result, a series of openings 40 are provided along the intermittent sealing line 38. As a result of operation of the vacuum pump 30 the air within the tubular film 11A is evacuated through the openings 40 and drawn out through the open end 31A of pipe 31. Following this, as the tubular film, with the articles 33 contained therein move further the film tube is sealed together in a transverse direction between the packages and transversely severed by the rollers 30A of enclosing mechanism to provide the finished goods shown in FIG. 5.

While the preceding embodiment of the invention discloses the slot 25, the sealing mechanisms 26 and vacuum pipe 31 as being arranged along the upper portion of the forming guide 17, it should be apparent that their positions could be arranged on the lower side of former 17.

Figure 6:
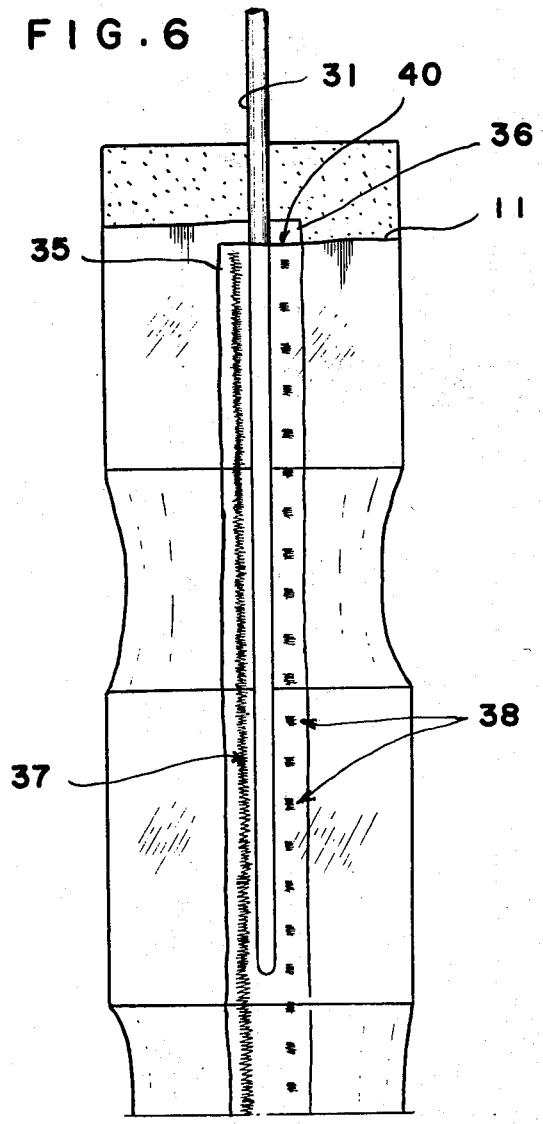
FIGS. 6 and 7 are diagrammatic views of two modified forms of the invention.

A modified form of the invention is shown in FIG. 6, in which one of the margins 35 of film 11 is laid upon the other margin 36 in overlapping relationship, with the vacuum supply pipe 31 interposed between them. In this case the two margins are sealed together along the continuous line 37 on one side of pipe 31 and near the edge of the exposed margin 35. On the other side of the pipe the two margins are sealed together at intervals along the discontinuous line 30 which leaves a succession of openings 40 provided by the unsealed portions of film along the line 38 through which air may be evacuated by the pipe 31.

Figure 7:
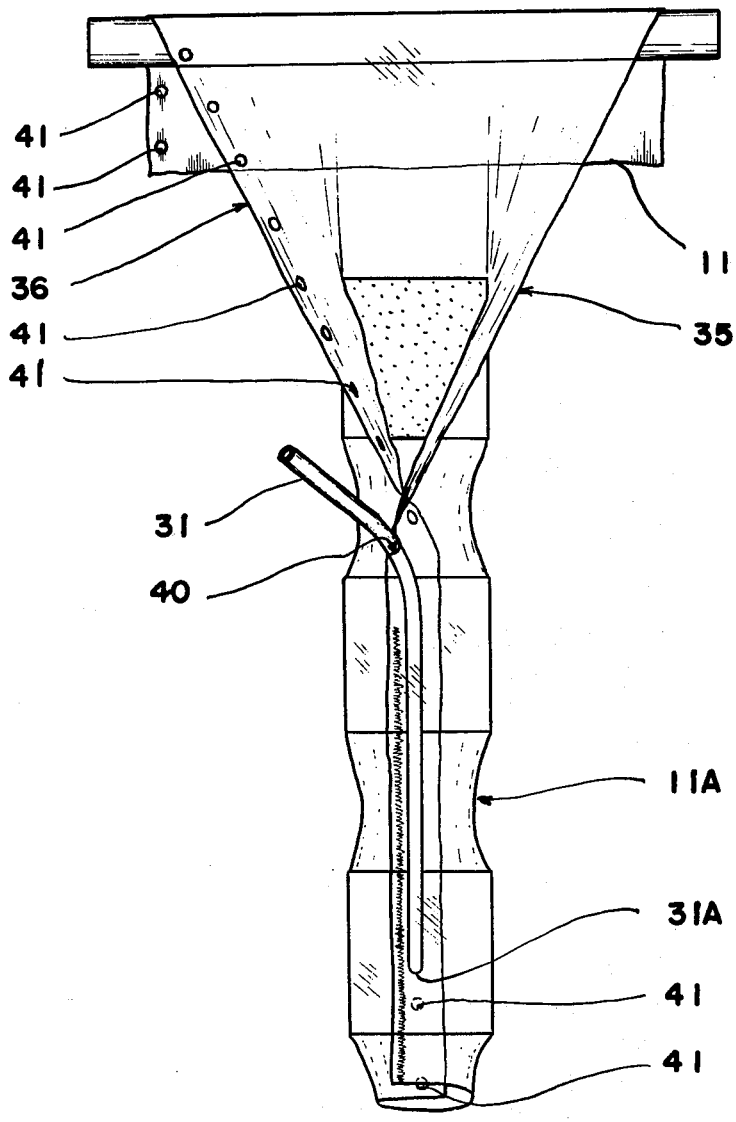

Another modification of the invention is shown in FIG. 7. In this modification a series of small holes 41 are provided in the film 11 at intervals spaced in a line close to one of the margins 36. The margin 35 overlaps the margin 36, as in the previous embodiment and the two layers of film are sealed together along the continuous line which lies outside of the openings 41 while the vacuum pipe enters the space between the margins through the gap 42 which is continuously formed as the film advances. Since air within the tube 11A can pass through the holes 41 there is no obstruction of air entering the inlet 31A of vacuum pipe 31.

As an alternative to heat sealing the respective ends of the package, it is possible to tighten the film at each end with a metallic ring, or employ a wire twist or other device to enclose the ends of the packages.

I claim:

1. In packaging apparatus of the type wherein a continuous length of thin flexible heat-sealable film and a succession of articles to be enclosed in said film are introduced into an elongated generally tubular film forming guide means for progressively wrapping the film around the respective opposite sides of the articles to bring the respective side margins of the length of film together to be heat-sealed along their lengths, said apparatus including means to subject the space enclosed by said film during said wrapping to the influence of a source of vacuum, the improvement which comprises means to heat seal said respective side margins of the film together along a continuous line, and means to position an inlet means for said source of vacuum out of contact with said articles and within the space enclosed by said film when sealed along said continuous line, said tubular forming guide means being provided with a longitudinally extending opening through which the respective margins of the film exteriorly project, said heat sealing means being provided adjacent the exterior of said elongated opening to press said margins together on a first continuous line and on a second intermittent parallel line spaced inwardly from the first line, said inlet means for the vacuum source being positioned exteriorly of said forming guide means and within the enclosure defined by said first and second lines of sealing, the intervals in the intermittent second line of sealing providing communication between said inlet means and the space occupied by said articles.

2. Packaging apparatus of claim 1, wherein said heat sealing means comprises a pair of cooperating heated rollers disposed for engagement with two opposite sides of said side margins of the film projecting exteriorly of said elongated opening, at least one of said rollers having a continuous peripheral surface for continuous contact with the film margins engaged by the peripheral surface of the other roller and at least one of the rollers having a peripheral surface for intermittent contact with the film margins engaged by the peripheral surface of the roller for intermittent sealing of the margins along a line spaced from the line of continuous sealing produced by said continuous contact, and means to accommodate a vacuum supply pipe connected with said inlet means between said cooperating rollers and between said lines of sealing.

3. Packaging apparatus of claim 2, wherein said cooperating heated rollers are provided with upper and lower cooperating annular flanges separated from each other by an annular groove, each of the upper flanges being provided with a continuous peripheral surface, each of the lower flanges being provided with interrupted tooth-like peripheral surfaces.

4. Packaging apparatus of any one of claims 1, 2 or 3 wherein said articles are spaced from each other and means is provided to heat seal the tubular portions of film disposed between said articles together along respective transverse lines to completely enclose each article in a wrapping of film.

5. Packaging apparatus of claim 4, wherein means is provided for severing said film transversely along said transverse lines of heat sealing to provide a succession of separate articles each completely wrapped in said film.

* * * * *